US007040125B2

(12) United States Patent
Ciezki et al.

(10) Patent No.: US 7,040,125 B2
(45) Date of Patent: May 9, 2006

(54) ELECTRONIC LOCKING SYSTEM

(75) Inventors: Roland Ciezki, Simmozheim (DE); Olaf Dressel, Priort (DE)

(73) Assignee: DIRAK Dieter Ramsauer Konstruktionselemente GmbH & Co. KG, Ennepetal (DE)

( * ) Notice: Subject to any disclaimer, the term of this patent is extended or adjusted under 35 U.S.C. 154(b) by 0 days.

(21) Appl. No.: 10/381,777

(22) PCT Filed: Sep. 19, 2001

(86) PCT No.: PCT/EP01/10811

§ 371 (c)(1),
(2), (4) Date: Jun. 23, 2003

(87) PCT Pub. No.: WO02/29186

PCT Pub. Date: Apr. 11, 2002

(65) Prior Publication Data

US 2004/0089035 A1 May 13, 2004

(30) Foreign Application Priority Data

Oct. 2, 2000 (DE) ..... 200 17 057

(51) Int. Cl.
*E05B 13/00* (2006.01)

(52) U.S. Cl. ..... 70/208; 70/210; 70/278.1; 70/278.7; 70/283; 292/336.3; 292/DIG. 31

(58) Field of Classification Search ..... 70/208, 70/210, 214, 278.1–278.3, 280–283, 278.7, 70/277, 279.1, 283.1, 213, 219, 220, 224; 292/DIG. 31, 336.3, 347
See application file for complete search history.

(56) References Cited

U.S. PATENT DOCUMENTS 4,770,012 A * 9/1988 Johansson et al. ..... 70/278.1
4,901,545 A * 2/1990 Bacon et al. ..... 70/278.3
5,184,491 A * 2/1993 Schittenhelm ..... 70/278.1
5,339,662 A * 8/1994 Goldman ..... 70/277

(Continued)

FOREIGN PATENT DOCUMENTS

DE 29806974 * 8/1998

(Continued)

*Primary Examiner*—Lloyd A. Gall
(74) *Attorney, Agent, or Firm*—Reed Smith LLP

(57) ABSTRACT

An electronic lock system comprises a recessed grip which can be mounted on a door leaf or the like, in which a lockable grip lever is held by one end around an axis parallel to the door leaf by the recessed grip or by a drive shaft for a bar lock, sash lock or the like which is held therein, and further comprises a locking device by which the grip lever can be locked into its position in which its is swiveled into the recessed grip. According to the invention, the locking device is constructed in a modular manner and comprises the following exchangeable components (modules): a base module with a movable bolt which, in its locking position, secures the grip lever in its swiveled in position, and with a device for supplying electric energy (e.g., a battery) for driving the movable bolt, which base module can be inserted through an opening formed by the recessed grip and can be secured therein. Also provided is an application module having the shape of a panel which covers the end of the base module inserted through the opening and whose panel surface projects into or through an aperture in the free end of the hand lever, or in which the hand lever is shortened in such a way that it releases the panel surface.

20 Claims, 9 Drawing Sheets

U.S. PATENT DOCUMENTS

| | | | | |
|---|---|---|---|---|
| 5,347,834 | A | 9/1994 | Ramsauer | 70/120 |
| 5,749,253 | A * | 5/1998 | Glick et al. | 70/278.2 |
| 5,894,277 | A | 4/1999 | Keskin et al. | 70/277 X |
| 5,970,757 | A * | 10/1999 | Ramsauer | 70/208 |
| 6,053,018 | A * | 4/2000 | Ramsauer | 70/208 |
| 6,098,433 | A * | 8/2000 | Maniaci | 70/278.1 |
| 6,374,652 | B1 * | 4/2002 | Hwang | 70/277 |
| 6,378,344 | B1 * | 4/2002 | Gartner | 70/278.1 |
| 6,490,896 | B1 * | 12/2002 | Segawa | 70/208 |
| 6,615,623 | B1 * | 9/2003 | Ormerod | 70/224 |
| 2003/0141724 | A1 * | 7/2003 | Ramsauer | 292/348 |

FOREIGN PATENT DOCUMENTS

| | | |
|---|---|---|
| WO | WO 85/03971 | 9/1985 |
| WO | WO 98/44223 | 10/1998 |

* cited by examiner

Module concept
EL-KEY system family

ELECTRONIC LOCKING SYSTEM

CROSS-REFERENCE TO RELATED APPLICATIONS

This application claims priority of International Application No. PCT/EP01/10811, filed Sep. 19, 2001 and German Application No. 200 17 057.0, filed Oct. 2, 2000, the complete disclosures of which are hereby incorporated by reference.

BACKGROUND OF THE INVENTION a) Field of the Invention

The invention is directed to an electronic lock system comprising a preferably standardized recessed grip which can be mounted on a door leaf or the like and in which a lockable grip lever is held by one end around an axis parallel to the door leaf by the handle recess or by a drive shaft for a bar lock, sash lock or the like which is held therein, and further comprising a locking device by which the grip lever can be locked into its position in which it is swiveled into the recessed grip.

b) Description of the Related Art

EP 0824624 B1 (U.S. Pat. No. 6,053,018) discloses a swivel lever actuating device which can be locked electrically or electronically and which likewise comprises a dish or recess that can be mounted on a door leaf or the like, an actuating lever for a lock such as a sash lock or bar lock being supported in this recess in such a way that it can be swiveled out of the recess and swiveled back into the recess around an axis parallel to the door leaf. Actuation of the lock is possible in the swiveled out position by turning the grip lever around a shaft that is guided vertically through the door leaf.

A disadvantage in the known swivel lever actuating device in EP 0824624 B1 is that it requires a special arrangement on the door frame in order to work correctly.

WO 85/03971 discloses a locking arrangement for doors and the like in which a bolt engages with a receiving member for holding the bolt, which process is checked electronically. Doors, shutters, covers, and so on, which protect electrical devices and machinery, for example, are monitored by the locking arrangement. Sensors which check the position of the bolt are used for checking the position of the lock and, accordingly, whether or not access is in fact blocked. This checking is carried out in a contactless manner by means of semiconductor devices. In addition to checking that a bolt is in its locking position or has at least been displaced into this locking position, it is also noted that other sensing devices can be provided in combination with keys to provide security devices that can unlock the lock. The lock is displaced by magnetic force generated by a coil which carries electric current supplied by a battery, for example. Manual actuating devices and, alternatively, automatic actuating devices are mentioned for actuating the doors, fastening arrangement and the like. The bolt can be spring-loaded. Sensing signals and command signals can be transmitted by electric lines or optical fibers or by a co-magnetic radiation of any wavelength. Also noted in connection with these sensing arrangements are logical circuits for increased security. Coded cards and card readers are also employed in this connection instead of keys.

OBJECT AND SUMMARY OF THE INVENTION

It is the primary object of the invention to provide an electric lock system which includes the electrically lockable swivel lever actuating device of the type mentioned above, but is improved in such a way that it is applicable in many ways and, in particular, makes it possible to retrofit the locking system in existing lock systems. In particular, devices which must be mounted on the door frame or the like instead of on the door leaf are to be avoided.

In particular, the arrangement can be designed in such a way that it is usable in substantially conventional swivel lever latches. Finally, another object of the invention is to dispense with the formerly used keys for a cylinder lock or the like which are also prior art.

This object is met in that the locking device is constructed in a modular manner and comprises the following exchangeable component parts (modules):

a) a base module with a movable bolt which, in its locking position, secures the grip lever in its swiveled in or folded in position, and with a device for supplying electric energy for driving the movable bolt, which base module can be inserted through an opening formed by the recessed grip and can be secured therein;

b) an application module having the shape of a panel which covers the end of the base module inserted through the opening and whose panel surface projects through an aperture or notch in the free end of the hand lever or a shortening of the free end of the hand lever.

In particular, through the modular construction and exchangeability of the components (modules), the invention succeeds in making possible a more versatile application and replacing or exchanging existing modules with other modules, as the case may be.

By combining a base module with different application modules, it is possible in a simple manner to provide an electronic lock system which is adaptable to very different areas of use and can also be incorporated in networks in different ways.

The invention makes possible many embodiment forms. In one embodiment form, for example, the individual parts of the base module such as the drive unit, control electronics, and devices for generating electric voltage are also constructed in a modular manner, so that the supply of electric energy for actuating the bolt on the one hand and for the sensor apparatus and control apparatus on the other hand can be obtained in different ways depending on the area of use.

Accordingly, the modular device for generating electric voltage can be a receptacle space for (optionally rechargeable) batteries. This is a particularly inexpensive solution. Alternatively, the electric energy can also be supplied externally, for example, through a power supply or also by means of an external solar power system. For transponder applications and other electromagnetically controlled devices, the electric energy could also be transmitted by radio waves so as to obviate wire connections and the changing and recharging of batteries.

The panel of the application module can also be designed in many different ways. For example, the panel of the application module could have a keyboard comprising a plurality of keys, e.g., 12, and a multi-digit, e.g., 5-digit, character display and/or light emitting diodes.

The transponder mentioned above can also be accommodated in the application module in case transponders are to be used for transmission.

However, the panel can also have biometric fingerprint sensing.

Another possibility consists in connecting the lock to a network and using remote control.

Another alternative is to provide the application module with a reading device for a magnetic stripe or a reading device for a chip card.

The application module can also have a transmitting/receiving device for radio waves in order to carry out radio control.

Alternatively, an infrared interface can also be arranged in the application module.

For complicated or storable controls, the application module advantageously comprises a memory or storage, although this could also be arranged in the base module or externally.

A drive in which the base module comprises a spring-loaded catch or bolt with a cam path in which the cam of a motor gear unit engages has proven particularly reliable and economical with respect to power.

In mechanical respects, it is particularly advantageous when the locking device is a constructional unit that can be inserted into the recess and a pin or bolt for locking the actuating lever can be moved out or swiveled out of this constructional unit by means of an electric control signal.

For design reasons, it is advantageous when the electronics are held by the recess rather than by the actuating lever; that is, the actuating lever advantageously has on its upper side in the area of the constructional unit an aperture or reduction through which or past which the constructional unit inserted into the recess is accessible when the actuating lever is swiveled in.

The aperture can have the size and shape of a fingerprint, in which case the accessible surface of the constructional unit would carry a fingerprint sensor surface.

Alternatively, the aperture could provide access to a keyboard arranged on the constructional unit. A reading device for reading a magnetic stripe can also be provided instead of the keyboard.

Alternatively, a reading device for a chip card is also possible. A reading/writing device operating with a transponder could also be provided.

Finally, the constructional unit could have a light-sensitive element for supplying and reading out the signals via an infrared light beam device.

The constructional unit advisably has a microprocessor chip which can be constructed by modern techniques so as to be very small and can easily be accommodated in the available space.

BRIEF DESCRIPTION OF THE DRAWINGS

The invention will be described more fully in the following with reference to embodiment examples shown in the drawings.

DESCRIPTION OF THE PREFERRED EMBODIMENTS

Figure 1A:
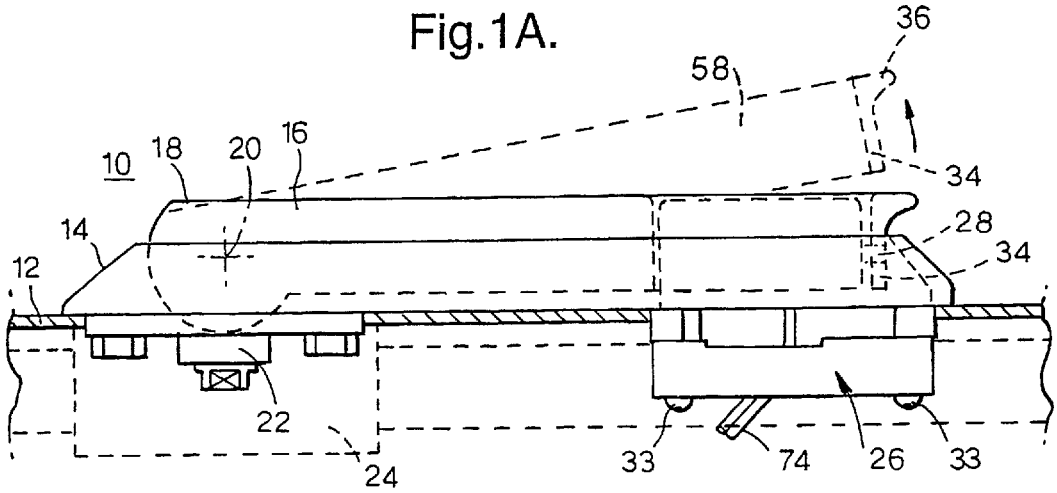
FIG. 1A is a side view showing a swivel lever bar lock that is constructed according to the invention and makes up part of the system.

An electronic lock system 10 is shown in FIGS. 1A, 1B, 1C and 1D in a side view, top view, axial section and sectional top view. The electronic lock system 10 comprises a standardized recessed grip 14 which can be mounted on a door leaf 12 or the like, in which a lockable grip lever 16 is held by one end 18 around an axis 20 parallel to the door leaf 12 by the recessed grip 14 or by a drive shaft 22 for a bar lock 24, sash lock or the like which is held therein, and further comprises a lock arrangement 26 by which the grip lever 16 can be locked (by means of bolt 28) into its position in which its is swiveled into the recess 14.

Figure 9:
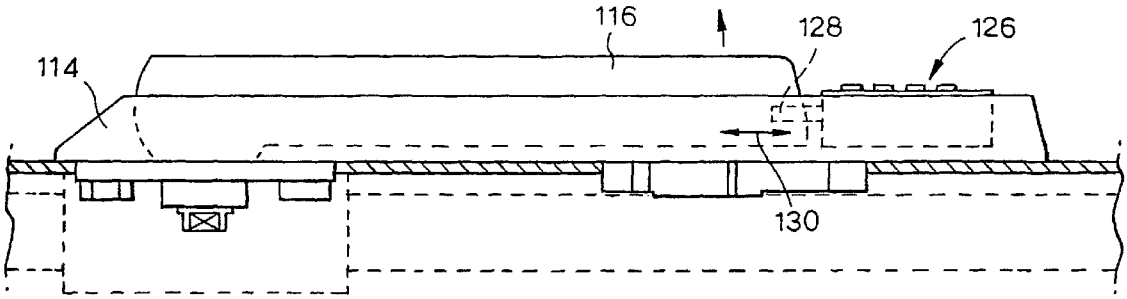
FIG. 9 is a side view showing an alternative embodiment form of a swivel lever lock.
Figure 10:
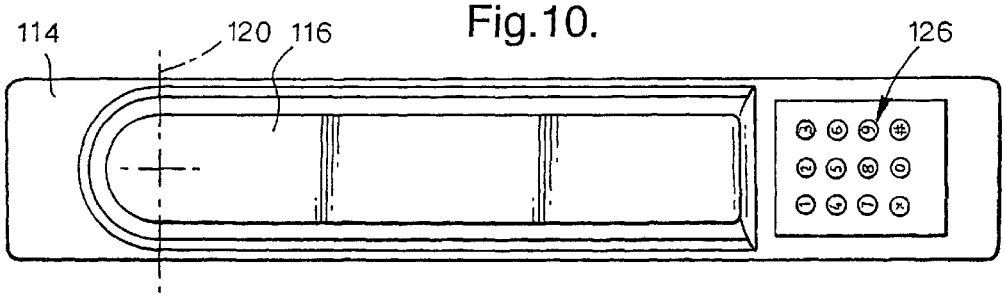
FIG. 10 shows a top view of the arrangement according to FIG. 9.

This locking device 126 can be arranged outside the area of the lever 116 according to FIGS. 9 and 10. This requires a modification of the recess to accommodate the locking device 126 and, further, leads to an increased overall length. It is more favorable, according to FIGS. 1A, 1B, 1C and 1D, to provide the locking device 126 in an opening which is already present in any case and which is usually provided for a cylinder lock, but in this case is made available to the locking devices constructed in appropriate form (see FIG. 3). In this case, a modification of the actuating lever 16 is required, whereas the recess can remain unchanged. This results in a shorter overall length.

Figure 3:
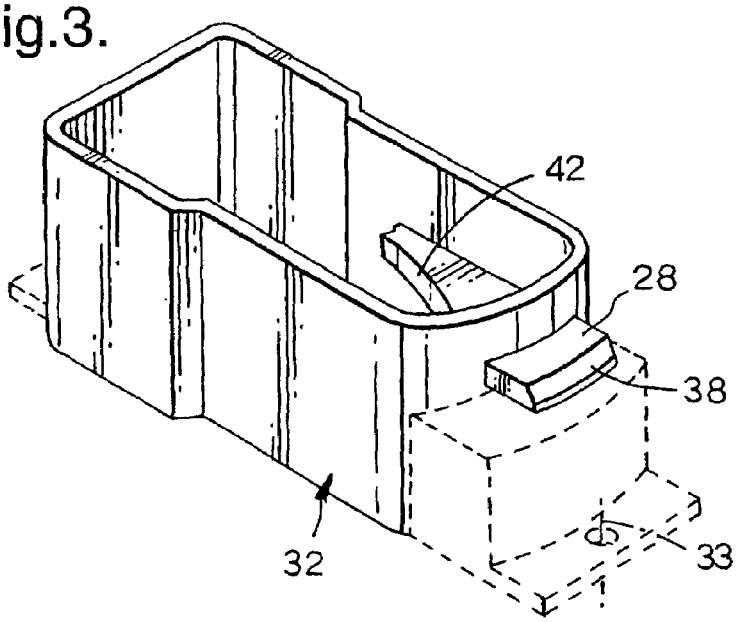
FIG. 3 is a perspective view of the insert from FIG. 2.
Figure 4:
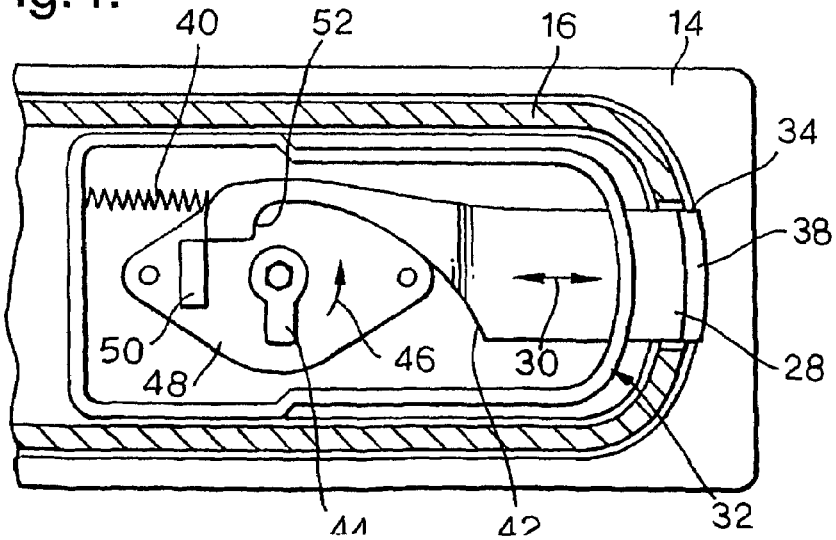
FIG. 4 is a top view of the insert having the bolt provided with a drive device according to FIGS. 2 and 3.

The locking unit is also constructed basically in modular manner and, in particular, comprises the following interchangeable components:

a) a base module 32 with a movable bolt 28 which executes a swiveling movement or, as in the present case, a translational movement in direction of arrow 30 (see FIGS. 3 and 4). When moved out, the bolt tongue 28 enters into a slit-shaped aperture 34 which is formed in the front wall 36 of the hand lever 16 (see FIGS. 1A, 1C and 4).

The bolt forms an inclined surface 38 and also allows a movement, along the arrow 30 directed toward the left, against the force of the spring 40 similar to a door latch and accordingly makes it possible to press the hand lever 16 into the recess 14 without having to actuate the lock itself: when the lever 16 is swiveled in, the inclined surface 38 of the bolt 28 contacts at the edge of the front wall 36 and is pushed back by the latter against the force of the spring 40 and slides along the front wall until it reaches the area of the opening 34, whereupon the bolt is pushed outward again into the locking position by the spring force of the spring 40.

In the locked position, the bolt 28 secures the grip lever 16 in its swiveled in or folded in position. This spring-loaded latch 38 is unlocked by a cam path 42 in which the cam 44 of a motor 48 provided with a gear unit engages when the cam 44 turns in the direction of arrow 46. During its rotating movement, the cam pushes the bolt 30 against the force of the spring 40 along a guide 50 (FIG. 4) or 51 (FIG. 1D) until the bolt 28 exits from the opening 34 and releases the hand lever that was pressed in against spring force, for example, and can swivel out.

As soon as the cam 44 exits the cam path at edge 52 again, the bolt 28 is released and is moved into its pushed out position by the force of the spring.

Figure 1B:
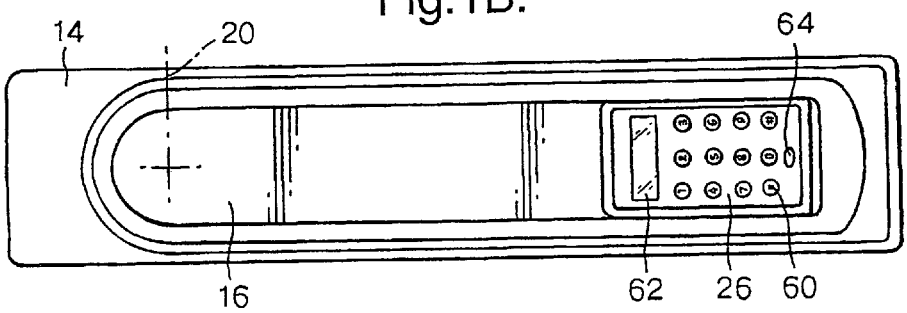
FIG. 1B is a top view of the arrangement according to FIG. 1.
Figure 1C:
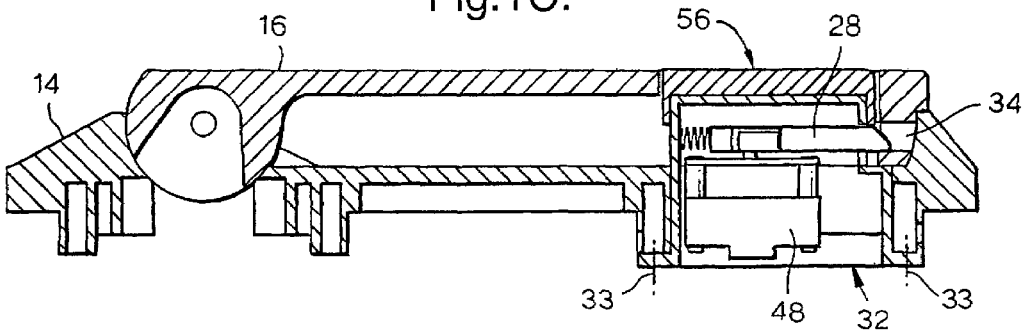
FIG. 1C is an axial sectional view through the arrangement according to FIG. 1.
Figure 1D:
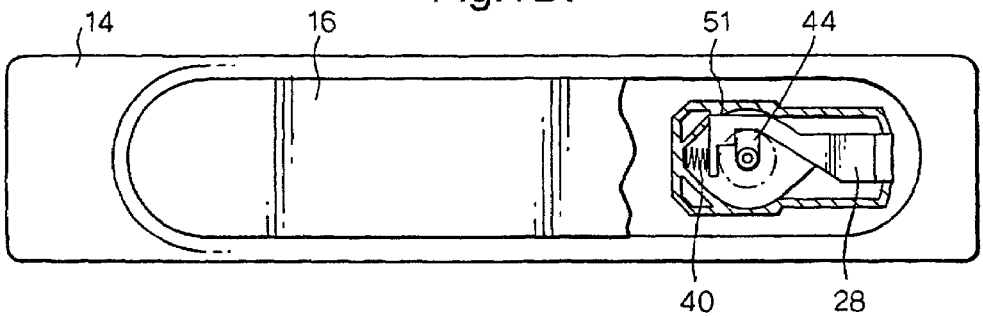
FIG. 1D is a top view in partial section of the arrangement according to FIG. 1.
Figure 2:
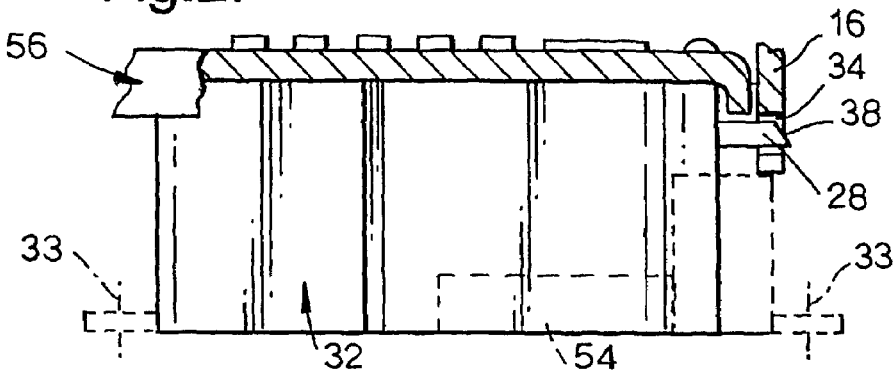
FIG. 2 is a side view of the insert that can be inserted into a common recess for carrying out the lock shown in FIGS. 1A–1D.

The motor 48 is driven by a device for supplying electric voltage which can likewise be contained in the base module, e.g., in the form of a (optionally rechargeable) battery which is accommodated in a receptacle space for this battery (see 54). An application module 56 can be mounted on or attached to the base module 32 and is in the form of a cover or panel and accordingly closes the space in the base module that contains the motor (see FIGS. 1C and 2). The outer surface of the panel extends through an aperture or a notch 58 in the free end of the hand lever 16 and carries control elements for the bolt movement of the locking device 26 of the base module 32. In FIG. 1B, the panel of the application module 56 has a keyboard 60 comprising a plurality of keys, in this case twelve keys, and a multi-digit, e.g., 5-digit, character display 62 and one or more light emitting diodes 64. Base module 32 and application module 56 together form an "opener module" 57 according to the module concept in FIG. 13.

Figure 6:
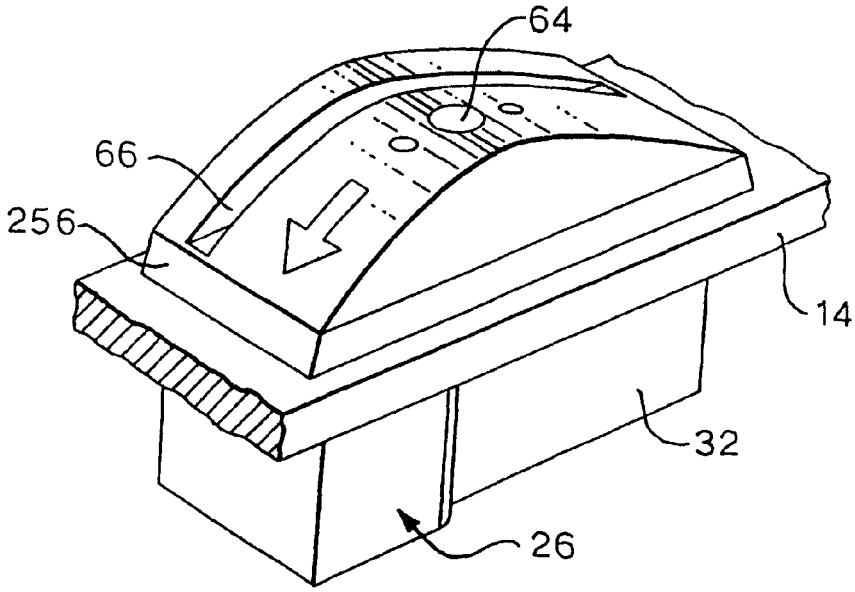
FIG. 6 is a view of an application module with a card reading device.

The application module 56 can be exchanged and, for example, replaced by an application module 256 according to FIG. 6 which, in place of a keyboard 60, has a reading device for a magnetic stripe of a magnetic stripe card which must be drawn through the slot 66 in order for data to be read from the magnetic stripe.

Additional light emitting diodes 64 or other display devices can also be provided (see FIG. 6).

Figure 5:
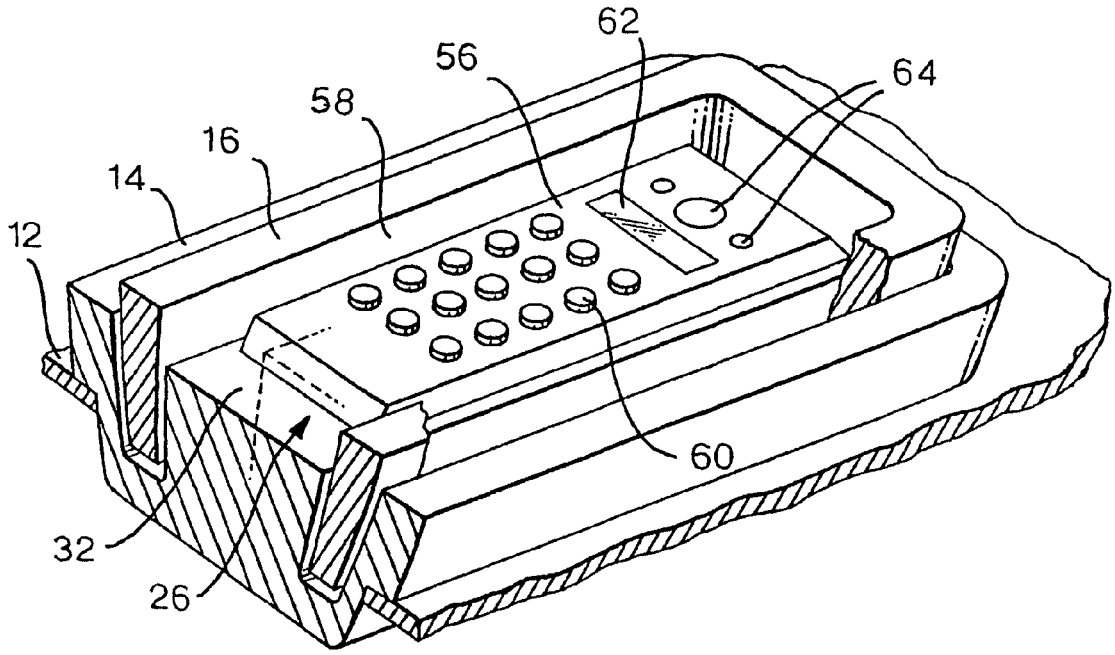
FIG. 5 shows a partial section through the swivel lever lock shown in the preceding Figures with an application module having a keyboard, a detail display and signal devices.
Figure 7:
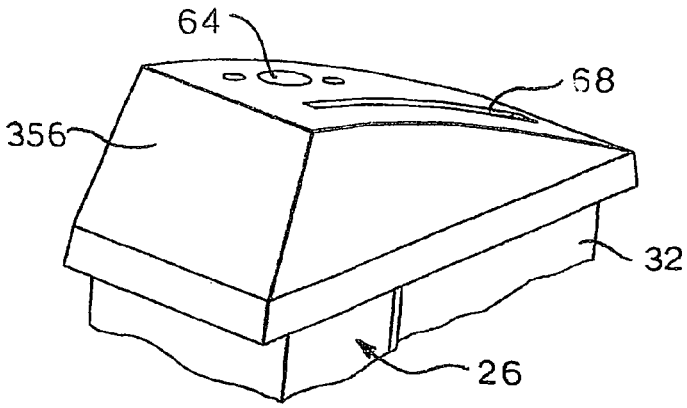
FIG. 7 shows a corresponding module with a chip reading device.

FIG. 7 shows an application module 356 which, in combination with the same base module 32 according to FIGS. 5 and 6, makes it possible to read a chip card that is inserted into a slot 68.

Figure 8:
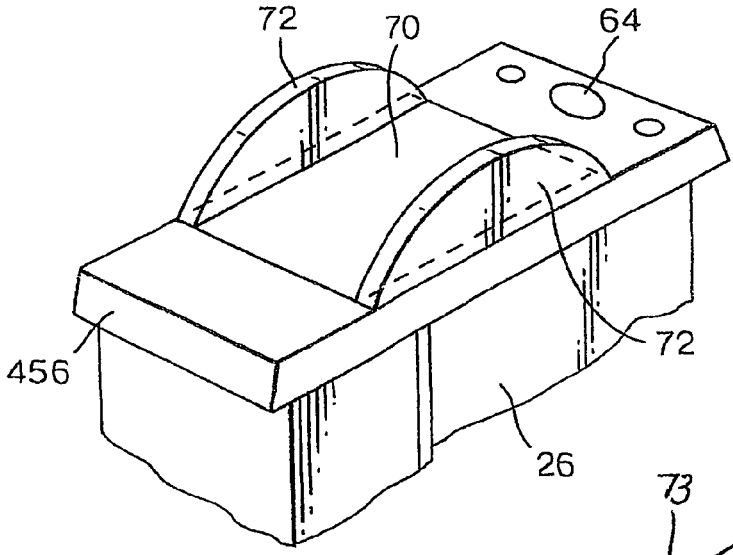
FIG. 8 shows a corresponding module with a fingerprint reading device.
Figure 8A:
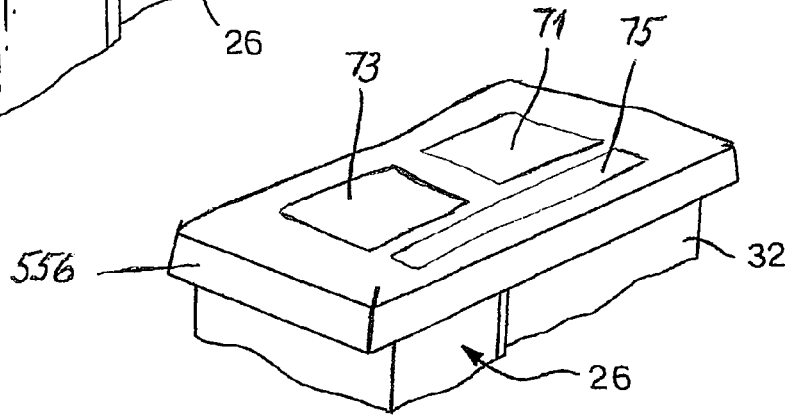
FIG. 8A shows a corresponding module with a transponder.

Finally, FIG. 8 shows an application module 456 with a biometric fingerprint reading device 70, wherein the thumb or finger is guided through side walls 72. FIG. 8A shows an application module 556 with a transponder 71. Also, application module 556 has a data storage 73 and a microprocessor chip 75.

The base module can also be connected to a network, not shown here, by cable connections 74 in FIG. 1A.

An application module in which a transmitting/receiving device for radio waves is provided is not shown; neither is an application module forming an infrared interface.

The base module, and possibly also the application modules, will usually comprise a data storage which makes read data available to a microprocessor that can be contained in the base module.

As follows from the preceding, the lock system according to the invention makes it possible to provide a product range of electronic locks which can be inserted into standard recessed grips. For this purpose, it is only necessary to exchange the grip and the lock projection, and a complete disassembly of the handle mechanism is not required. Further, the lock engages directly in the grip and accordingly provides a particularly stable protection against unauthorized opening. The system according to the invention makes possible variants for operation without external power supply (battery-supplied) and for continuous operation with external power supply. This can also be combined in that continuous operation is possible with external power supply and emergency operation is possible without external power supply with a battery.

Figure 11:
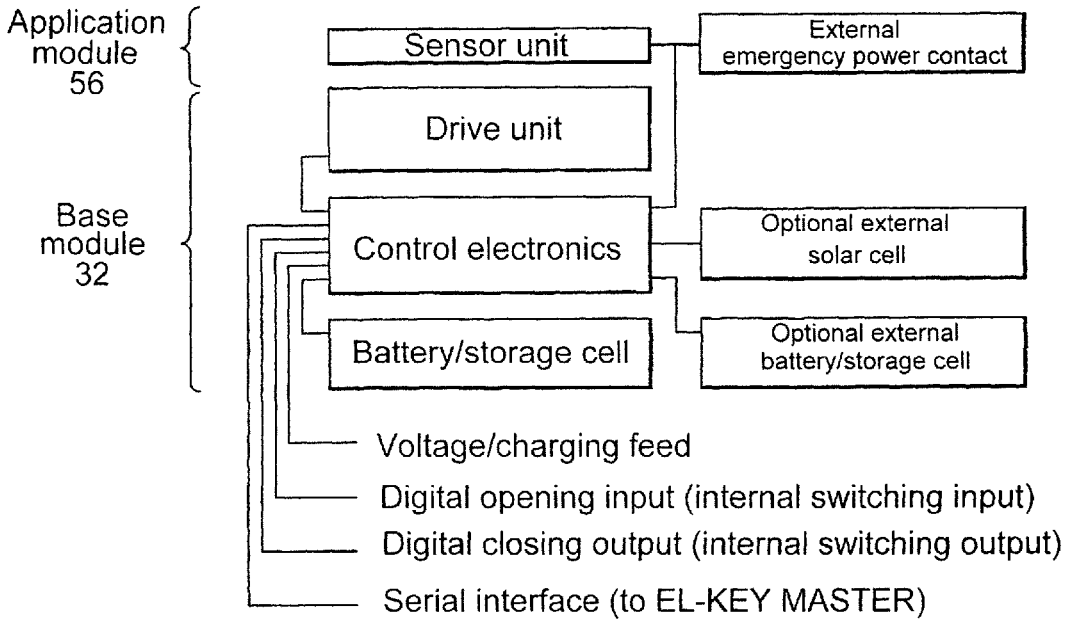
FIG. 11 shows a form of the modular construction.
Figure 13:
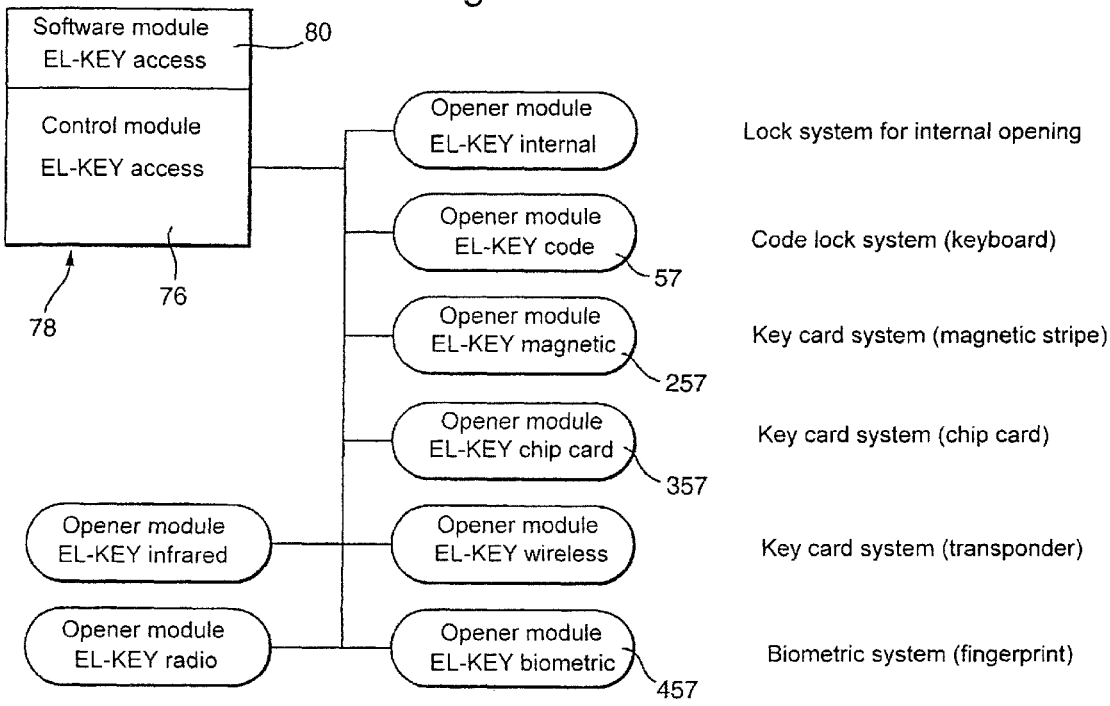
FIG. 13 illustrates the module concept.

As was already mentioned, the construction is extremely simple and, according to FIG. 11, comprises a base module (including battery module, control module and drive module) and an application module. The base module contains voltage-generating means, wherein a voltage of 5 V which is necessary for the operation of the microprocessor can be generated from a battery voltage of 1.2 V. The voltage of the battery or storage cell is monitored during operation and weak charge states are displayed visually by the light emitting diodes (LEDs), for example. In case of a network connection, this report can be evaluated centrally, e.g., in the control module of a center 78 which can also comprise a software package (software module 80) (FIG. 13). A battery module with, e.g., two 1.5 V storage cells or batteries or a voltage connection adapter is connected to the base module.

The exchangeability of the application module allows optionally a code lock (code is entered by keyboard), a transponder lock, fingerprint identification (by biometry), and a network version which can also possibly be combined with the applications mentioned above. Further, an application module with magnetic stripes, chip cards and transponders is possible.

Code Keyboard

The application module is mounted on the base module and has, e.g., in the case of a code lock, a 12-key keyboard and a numeric display with four digits. More digits are possible but are usually unnecessary.

A light emitting diode shows the input status and, optionally, the battery status.

When operating with external power supply, four bars, for example, are displayed in the display; when operating without an external power supply, display is carried out after actuating a key in order to economize on power. A code of only four digits (or more, if desired) is entered. The lock is opened after the fourth digit is entered correctly. When entering a programming code (for example, four digits plus four digits or more), a code can be added or canceled.

Transponder

When using a transponder, the application module is again mounted on the base module, but contains a closed panel and a light emitting diode, as well as a hidden reed contact. The transponders are wound on a permanent magnet. A light emitting diode shows the input status or, optionally, the battery status. The module can also function independently.

The operating function is carried out in such a way that, e.g., the LED turns red when operating with external power supply. When operating without external power supply, this is indicated by green based on the correct transponder with magnet. The code is now read from the transponder, and the lock opens when the transponder is correct. Authorizations are issued via a master transponder or via a connected PC network.

Network

When a network is used (FIG. 12), an application module is mounted on the base module and receives a closed panel and, e.g., a light emitting diode. A light emitting diode shows the input status and, optionally, the network connection.

In the operating state (only with external power supply, e.g., by means of power supply 84 via line 82, 182, 282 (FIG. 12)), the light emitting diode is red. After the opening command via network 86 and line 186, 286, 384, the light emitting diode is red. There is one control module 76 (FIG. 13) for a plurality of network-ready devices, which control module 76 can serve the individual devices 57.

Fingerprint

When using the fingerprint recognition method or biometry, the application module is mounted on the base module and receives a panel with integrated fingerprint sensor and a light emitting diode. A light emitting diode shows the input status and, optionally, the network connection.

In the operating state (only with external power supply, e.g., according to FIG. 12), the light emitting diode is red. After the opening command via the control module 76, the light emitting diode is green. There is one control module for a plurality of fingerprint devices, which control module can serve the individual devices and evaluate the data of the sensors on the doors.

The control module contains the fingerprint data.

The base module, designated by 32 in FIG. 3, is inserted from below into the recessed grip by its upper, possibly narrower, part and is screwed together with it, e.g., by means of screws 33. The selected application module 56 is then mounted from the top in the recessed grip and on the upper end of the base module 32 and, e.g., is likewise screwed to it and electrically connected to it (e.g., by cable or plug-in connectors).

The concept of modular construction is clearly illustrated once again in FIG. 11. A system that is outfitted according to the invention comprises a sensor unit which is connected with control electronics, likewise a module. The drive unit which makes the bolt movement possible is connected with the control electronics.

The control electronics can be connected optionally either to an external solar cell with an optionally external battery or storage cell or with an internal battery or storage cell device.

The sensor with sensor unit, the drive unit, the control electronics and an internal battery or storage cell are internal.

The solar cell or external battery is external. In order to make possible an optional external power feed, the sensor unit and the control electronics can also be outfitted with corresponding voltage contacts.

Figure 12:
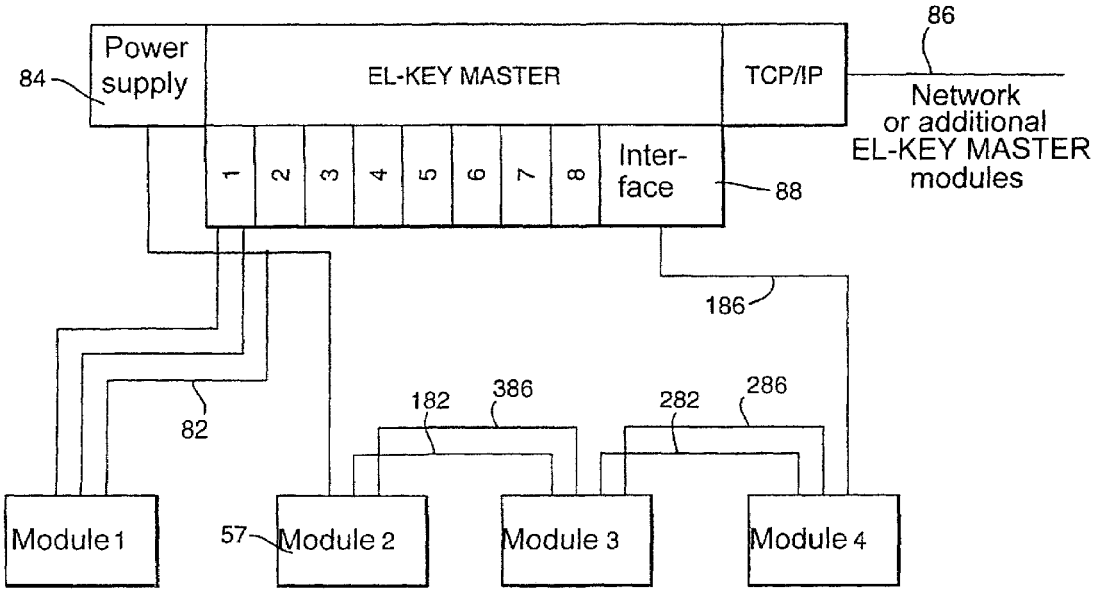
FIG. 12 shows modules in the network.

Further, a power and charging feed (for charging a battery), a digital opening input (to enable an externally triggered opening process), a digital closing output (to trigger an external closing process) and a serial interface 88 (to a network 86) can be guided to the control electronics (see FIG. 12).

FIG. 12 shows how a plurality of modules can be interconnected. Accordingly, as shown in FIG. 12, modules 1 and 2 are connected via line 82 to a power supply 84, while modules 3 and 4 are supplied by module 2 via lines 386, 286. A first interface supplies module 1 with data. Modules 2, 3 and 4 are supplied with data by the interface 88. The latter communicates in turn, via block TCP/IP, with the Internet or another network or with another module according to the invention or an electronic central closing control 78 ("EL-KEY MASTER").

COMMERCIAL APPLICABILITY

The invention is commercially applicable in switch cabinet construction.

While the foregoing description and drawings represent the present invention, it will be obvious to those skilled in the art that various changes may be made therein without departing from the true spirit and scope of the present invention.

The invention claimed is:

1. An electronic lock system comprising:

a recessed grip which can be mounted on a door leaf, in which a lockable grip lever is held by one end around an axis parallel to the door leaf by the recessed grip or by a drive shaft for a bar lock or sash lock which is held therein; and a locking device by which the grip lever can be locked into its position in which it is swiveled into the recessed grip;

said locking device being constructed in a modular manner and comprising the following exchangeable components:

a) a base module with a movable bolt which, in its locking position, secures the grip lever in its swiveled in or folded in position, and with a device for supplying electric energy for driving the movable bolt, which base module can be inserted through an opening formed by the recessed grip and can be secured therein; and b) an application module having the shape of a panel which covers the end of the base module inserted through the opening and whose panel surface projects into or through an aperture in the free end of the grip lever.

2. The electronic lock system according to claim 1, wherein individual parts of the base module are also constructed as modules.

3. The electronic lock system according to claim 1, wherein a modular device for supplying electric energy is a receptacle space for battery cells.

4. The electronic lock system according to claim 1, wherein the base module also has an electrical connection for an external solar cell, an external battery or an external emergency power device.

5. The electronic lock system according to claim 1, wherein a drive unit is constructed in a modular manner and comprises an electromechanical locking device from which a pin or bolt or projection for locking an actuating lever can be moved out or swiveled out by means of an electric control signal.

6. The electronic lock system according to claim 1, wherein the panel of the application module has a keyboard comprising a plurality of keys and a multi-digit character display and/or light emitting diodes.

7. The electronic lock system according to claim 6, including a keyboard with keys and a 5-digit character display.

8. The electronic lock system according to claim 1, wherein a transponder is accommodated in the application module.

9. The electronic lock system according to claim 1, wherein the panel of the application module has biometric fingerprint sensing.

10. The electronic lock system according to claim 1, wherein the application module comprises a reading device for a magnetic stripe.

11. The electronic lock system according to claim 1, wherein the application module comprises a reading device for a chip card.

12. The electronic lock system according to claim 1, wherein the application module has a transmitting/receiving device for radio waves.

13. The electronic lock system according to clam 1, wherein the application module forms an infrared interface.

14. The electronic lock system according to claim 1, wherein the base module and/or the application module comprise(s) a data storage.

15. The electronic lock system according to claim 1, wherein the base module and/or the application module comprise(s) a microprocessor chip.

16. The electronic lock system according to claim 1, wherein the base module comprises a spring-loaded catch or bolt with a cam path in which the cam of a motor gear unit engages.

17. The electronic lock system according to claim 1, wherein the base module has control electronics that are connected to a network or to additional modules.

18. The electronic lock system according to claim 1, wherein the base module and application module form an opener module.

19. The electronic lock system according to claim 18, wherein said system has a central control to which a plurality of opener modules are connected.

20. The electronic lock system according to claim 19, wherein the central control comprises a control module and a software module.

* * * * *